US006159034A

United States Patent [19]

Royer

[11] Patent Number: 6,159,034

[45] Date of Patent: Dec. 12, 2000

[54] SAFETY COVER FOR ELECTRICAL OUTLETS

[76] Inventor: George R. Royer, 2137 Ragan Woods Dr., Toledo, Ohio 43614

[21] Appl. No.: 09/088,060

[22] Filed: Jun. 1, 1998

[51] Int. Cl.[7] ..... H01R 13/62

[52] U.S. Cl. ..... 439/373; 439/144

[58] Field of Search ..... 439/144, 147, 439/373; 174/67

[56] References Cited

U.S. PATENT DOCUMENTS

| | | | |
|---|---|---|---|
| 2,510,745 | 6/1950 | Kilgore | 439/373 |
| 3,656,083 | 4/1972 | Brook | 439/147 |
| 3,955,870 | 5/1976 | Wasserman | 439/144 |
| 4,895,527 | 1/1990 | Brown et al. | 439/332 |

*Primary Examiner*—Paula Bradley
*Assistant Examiner*—Alexander Gilman

[57] ABSTRACT

The subject device is a protective safety cover for electrical outlets of the type affixed to the side of a wall or other building appurtenances, and is a device functioning mainly to protect young children from pulling electrical appliance plugs as inserted in electrical outlets, and comprises a door-like cover member, said door-like cover member being adapted to be mounted in a hinged manner over the existing outlet plate affixed to the wall, or alternatively may be structured as a unitary member with an integrated outlet plate permanently hinged to the door member, and in addition, the subject cover member is provided with one or more appropriately positioned openings which correspond in position to align with the respective inserted electrical plugs when the cover door member is in the closed position, such circular openings being of sufficient diameter to receive a portion of an electrical with the cover door member having slits extending from the non-hinged side to the openings in the cover door member, or other means may be used to accommodate the trailing cords of the electrical plug so that the cover door can be shut over or around such cords.

1 Claim, 3 Drawing Sheets

SAFETY COVER FOR ELECTRICAL OUTLETS

KNOWN PRIOR ART

U.S. Pat. No. 3,789,107, and all references cited therein (Copy attached).

DISCUSSION OF PRIOR ART

The subject invention relates to wall type electrical outlet sockets that are adapted to receive the prongs of a plug on an electrical cord which lead from a connected electrical appliance. Stated alternatively, the invention herein is directed to safety covers for such electrical outlets that are adapted to receive a prong type electrical plug for purposes of completing an electrical circuit to a corresponding electrical appliance. More particularly, the invention is directed to a safety cover plate adapted to prevent young children from pulling such electrical plugs from the outlet socket. The invention is also adapted to prevent children playing with and touching partially exposed prongs on an appliance plug, as partially inserted, in order to avoid the potential of electrical shock. Aesthetical advantages are a side-product of this invention.

One of the problems encountered with the use of wall type electrical outlets is that young children frequently try to pull an appliance plug while it is in the socket, or alternatively, they may try to play with a plug while the prongs are only partially inserted in the socket. Obviously, there is a danger involved in any such attempted manipulation of an electrical plug by a child, particularly at a time when the electrical plug is partially inserted, with the metal prongs partially inserted in the socket. This latter situation can lead to the potential of electrical shock.

Protecting individuals from such electrical dangers is not an easy task to overcome, since appliance plugs necessarily project outwardly from a socket receptacle with the corresponding electrical cord trailing behind. Since most of these outlets are positioned relatively low on the wall, they are accessible to small children. Moreover, so long as the insertible electrical plug is used under existing circumstances, the temptation of children to remove plugs will be likely, and therefore certain safety precautions should be employed for protective purposes.

In an attempt to alleviate this problem to some degree, certain devices have been conceived as a measure to prevent children from playing with such electrical plugs in the electrical outlets. One such known protective device is a flat face member having two male prongs, the entire device generally being comprised of a non-conducting material. This latter device is designed to be inserted in an unused electrical outlet to discourage or keep children from placing their fingers into the female outlet receptacles to avoid electrical shock. One of the limitations of such a device is that children can easily pry the device out of an electrical socket, and thereupon its utility is negated completely. Moreover, such insertible devices are not conceived or structured to protect against children prying cut an already inserted plug and manipulate it in the partially unplugged position, as discussed above. As stated, this latter aspect may be more of a potential danger then the problem of exposed outlets. As a result, there is a need for an auxiliary device for protection against all the foregoing dangers, and while there are some devices conceived for this protection, the subject device is conceived as an improved device to protect against all such dangers, and the following objects of the invention are directed accordingly.

OBJECTS

In view of the foregoing, it is an object of the subject invention to provide an improved safety device for wall type electrical outlets;

It is also an object of the subject invention to provide a safety device for wall type electrical receptacles;

Yet another object of the subject invention is to provide a safety device for attachment to a wall type electrical outlet to prevent children from pulling plugs and placing their fingers into outlet receptacles or on any partially exposed plug prongs;

Still another object of the subject invention is to provide an improved safety feature for electrical outlets for prevention of children endangering themselves;

A further object of the subject invention is to provide an improved cover plate for electrical outlets;

Another object of the subject invention is to provide an improved safety device for electrical appliance plugs;

Still another object of the subject invention is to provide an improved electrical safety device;

Another object of the subject invention is to provide a device for limiting a child's access to electrical outlets or appliance plugs when inserted in an outlet receptacle;

Other objects of the subject invention include the concept of improving safety for electrical outlets;

Another object of the subject invention is to provide an improved electrical outlet cover for aesthetical purposes.

Other and further objects of the subject invention will become manifest upon review of the following description taken in conjunction with the claims.

DESCRIPTION OF GENERAL EMBODIMENT

The subject device is a protective safety cover for electrical outlets of the type affixed to the side of a wall or other building appurtenances. The subject outlet cover is a device functioning mainly to protect young children from pulling electrical appliance plugs as inserted in electrical outlets, and comprises a door-like cover member, said door-like cover member being adapted to be mounted in a hinged manner to an outlet plate. In addition, the subject cover member is provided with one or more appropriately positioned openings which correspond in position to align with the respective inserted electrical plug receptacles when the door-like cover is in the closed position. These openings are of sufficient diameter to receive a portion of an outlet plug of an electrical appliance when inserted in the adjoining outlet socket. The cover member is mounted on a hinged member to the side of the outlet plate so that it can be opened or closed over the outlet plate in door-like fashion. Further, the cover member has open slits extending from the side edge of the cover member that is opposite the side edge hinged or mounted to the outlet cover plate. For purposes of the invention herein, the door-like cover member and the electrical outlet cover plate may be structured as a unitary member.

Stated generally, the subject invention is directed to a covering device structured and adapted to be opened and closed partially or totally over an electrical socket outlet plate while an electrical plug or several such plugs are inserted in one or more electrical sockets. This covering device in its general form and embodiment is adapted to cover in part or totally any electrical plugs inserted in the sockets. For this purpose, the covering device has integrally including structural means to permit the covering device to close around and over any inserted electrical cords.

DESCRIPTION OF PREFERRED EMBODIMENT

In describing a preferred embodiment of the subject invention, it is stressed that the following description is of only one embodiment, and that such description should not limit the scope of the invention herein to one such embodiment.

Figure 4:
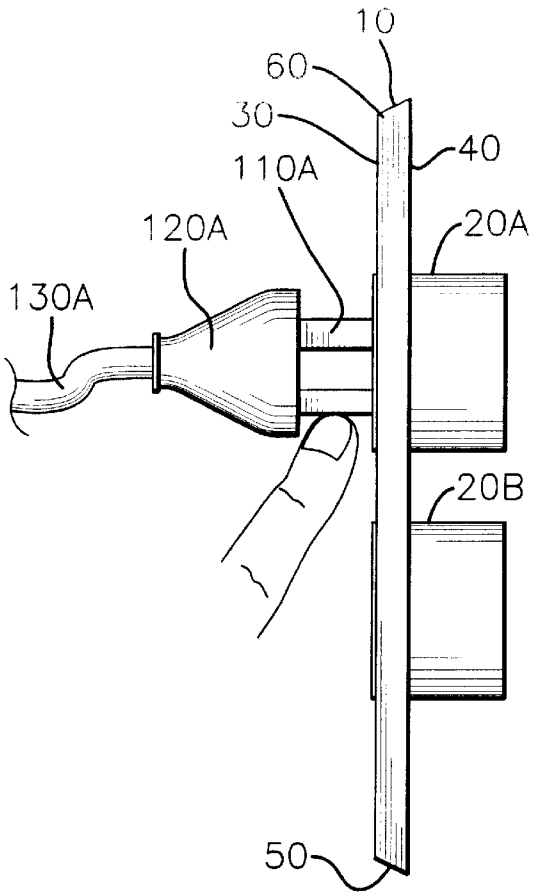
FIG. 4 is a side elevational view of the conventional electrical plate showing how plugs can be partially inserted with the attendant danger.

Referring now to the drawings in which a preferred embodiment of the subject invention is shown, an electrical outlet socket plate 10 is shown in FIG. 4 as attached to a wall 15 of a building. Electrical sockets 20A and 20B are mounted on Wall 15, as seen. For purposes of further orientation in describing the preferred embodiment herein, the word "outer" will refer to those spatial areas which are on the side of the wall 15 or outlet plate 10 opposite to that side of the wall 15 supporting the electrical socket 20A and 20B and other related electrical fixtures. Conversely, the word "inside" will refer to that side of the wall 15 which is on the same side as such sockets. Moreover, in the side elevational views of the drawings, the front of the electrical socket plate 10 is shown to the left in such drawings, while the back of the socket plate will be referred to those areas to the right in such drawings.

Figure 2:
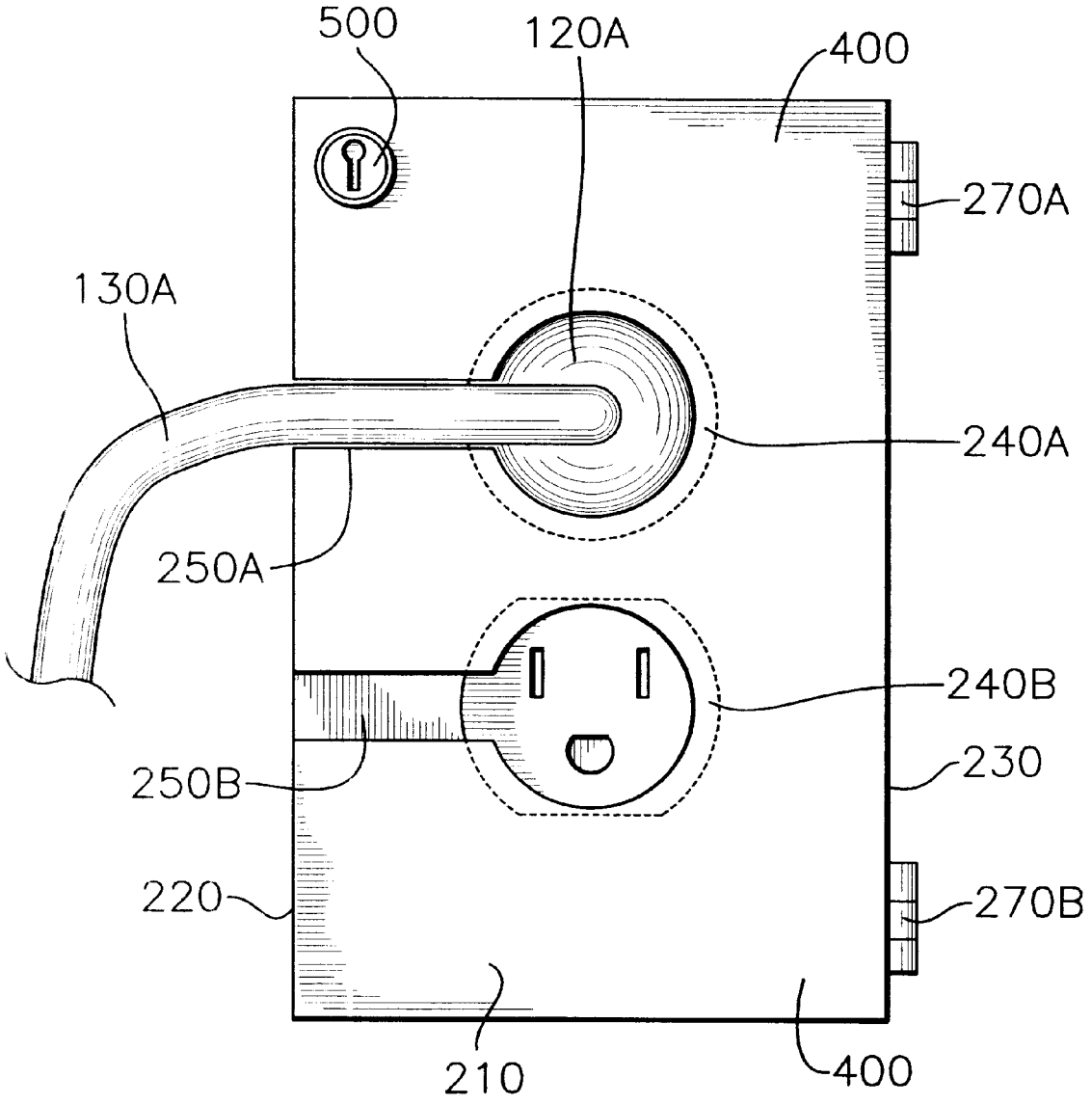
FIG. 2 is a front elevational view of the subject plate incorporating the subject invention.
Figure 3:
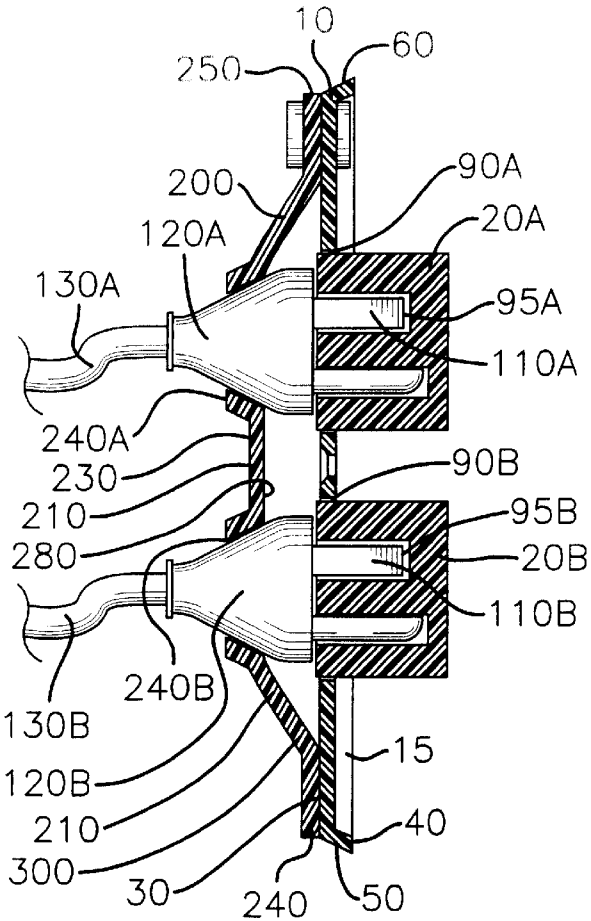
FIG. 3 is a side elevational view of the subject invention, in cross-section.

Referring now to the drawings, and particularly FIGS. 2 and 3 in which a preferred embodiment of the subject invention is shown, the electrical socket plate 10 is essentially conventionally structured, usually being a plastic based member of a rectangular configuration having a front surface 30 and an inner surface 40, with the inner surface 40 adapted to abut in a flush manner against the outer surface of the wall 15, and the outer surface 30, facing inwardly towards a room. Socket plate member 10 has bottom edge 50 and top edge 60 and a first side edge 70 and a second side edge 80. Socket plate 10 described above has one or more electrical socket openings 90A, 90B etc. . . . which socket openings are adapted to be placed in alignment with the electrical sockets 20A and 20B as seen. Each electrical socket 20A, 20B . . . has two female openings 95A, 100A and 95B and 100B respectively adapted to receive a mating male prongs 110A and 110B respectively affixed on electrical appliance plugs 120A and 120B that are adapted to be inserted in a particular socket 20A, 20B as seen. These structural characteristics are conventional. Moreover, each electrical plug 120A, 120B is connected to an electric cord member 130A, 130B, containing electrical wires that lead to a particular electrical appliance, not shown.

Figure 1:
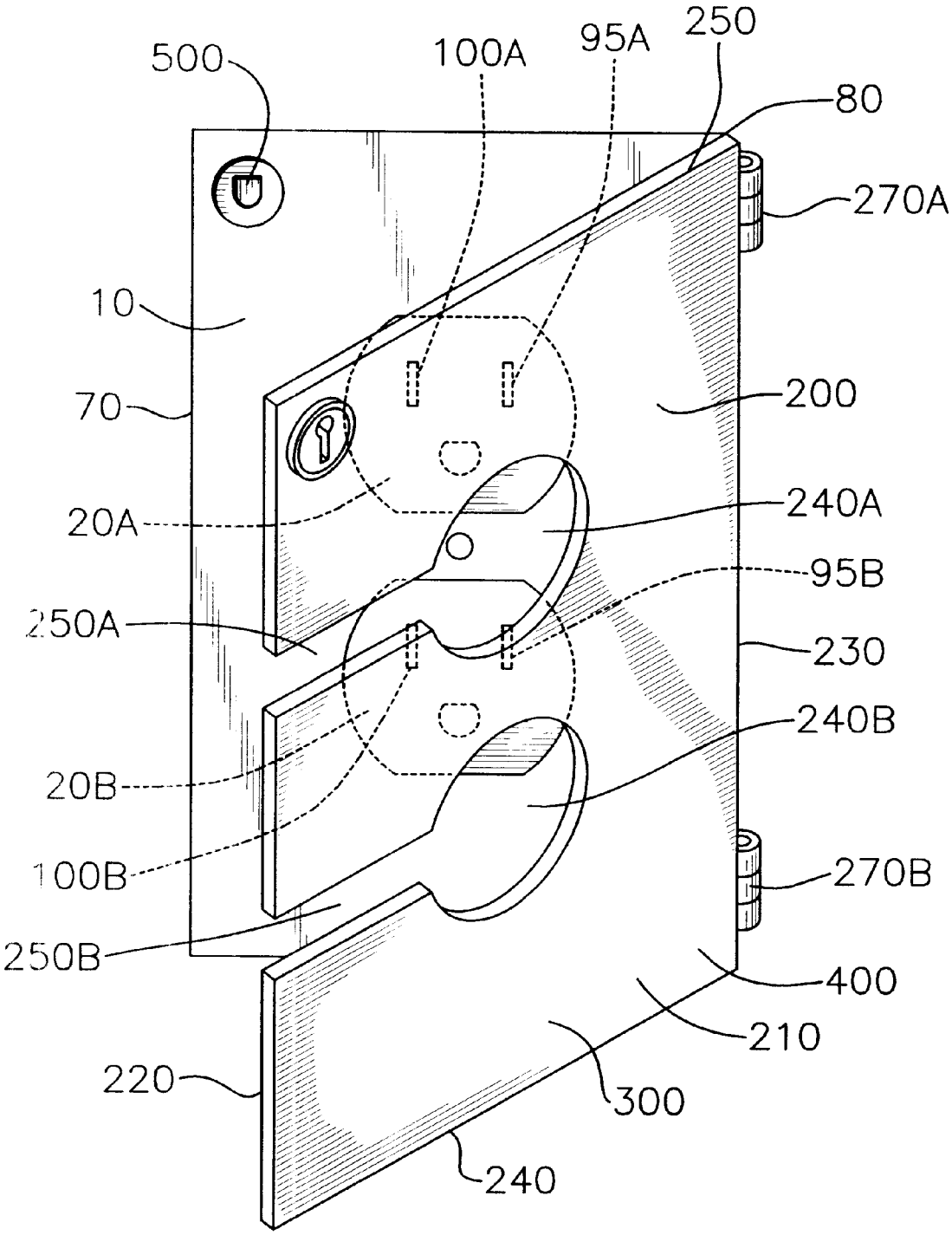
FIG. 1 is a perspective view of the subject member incorporating the subject invention.

In the foregoing described conventional structuring and use of an exposed socket plate 10 with the electrical plus as inserted are observable and accessible. The representation shown in FIG. 4 demonstrates this aspect of the subject invention is conceived to over come those discussed attributes. The subject invention is a covering device that is adapted to be opened and closed over a socket plate 10 to cover the socket plate as well as partially or totally cover the electrical appliance plugs 120A, 120B while inserted in sockets 20A, 20B and is adapted with means to open and close around the trailing cord member 130A, 130B of each plug member. Covering device 200, in the preferred embodiment of the subject invention is a covering that includes a door-like member 210 that is adapted to be pivotally mounted to a part of wall 15 or a part of the socket plate 10. Alternately the covering door 210 may be pivotally mounted to a socket plate member such that the socket plate and door member comprise a unitary member. The embodiment shown in FIG. 1 shows such an array.

In more detail, the main features of the door member 210 are set forth as follows.

Door member 210 is preferably, but not critically, rectangular in structural configuration, but may be shaped other than rectangular, and has two laterally disposed side edges, a first side edge 220 and a second side edge 230 forming generally parallel sides of door member 210. Additionally, door member 210 has a bottom edge 240 and a top edge 250 that are opposite to one another that are preferably, but not necessarily mutually perpendicular to the lateral sides of 220 and 230.

In the preferred embodiment of the subject invention the cover door member is formed and structured with one or more openings located in the approximate middle or center portion of the door. In the usual structural arrangement, there are two electrical sockets covered by the socket plate, and therefore, it is preferable to have two corresponding openings 240A and 240B in the middle portion of the cover door member 210, as seen in FIGS. 1, 2 and 3. These openings 240A and 240B are adapted to hold and surround a circumferential portion of an electrical plug as seen in FIGS. 2 and 3. Depending on the electrical structural circumstances and other attendant factors, one opening may be formed in cover door member 210 to accommodate one or more plugs, or more than two openings may be used.

As seen from FIGS. 1 and 2, the cover door member 210 in the preferred embodiment has separated slits 250A and 250B extending from the front side edge 220 of such cover door 210 completely through to the openings 240A and 240B respectively. More particularly, slit 240A is open at that particular side edge 220 that is not hinged to the cover plate preferably and generally extends in a generally perpendicular direction relative to the side edge 220, and extends in such perpendicular direction to the opening 240A where such slit is also open at the adjoining circumferential area of such opening 240A, so that the slit 250A extends in the opening 240A. In similar fashion, slit 240B extends completely from the edge 220 of door member 210 all the way into opening 240B. These slits 250A and 250B are adapted to receive the cord member for the plug of an electrical appliance such as cord members 260A and 260B respectively as shown in FIG. 3. This enables the door member 210 to be closed over the electrical plugs as inserted since the cord members can be threaded through the slits 250A and 250B so the door 210 can be closed to accommodate the trailing cord members as shown in FIG. 2.

Attention is drawn to the fact that the slits described above may be of any shape and direction other than perpendicular or longitudinal and may extend in any direction from any of the described edges of the door member 210, and thus can extend to the described openings from the bottom edge, the top edge or even the side edges that is hinged to the outlet plate 10. Thus, it is stressed at this juncture that the structural configuration of the door member 210 may vary from the descriptions above stated. Generally speaking, the cover door may include more or less than two openings, and may include one opening to accommodate and surround one or more plugs. Additionally, as discussed above, the openings 240A and 240B may be other than circular, and may, for example, be rectangular, oval, or elliptical, or other variant configuration in order to accommodate different shaped electrical plugs. Moreover, as to slit members 250A and 250B, more or less than two such slits may be employed with the subject invention and one such slit may be used to accommodate one or more appliance cords, with the slit or slits extending from the bottom or top edge as shown in FIG. 5.

The second side edge 230 of the cover door member 210 has pivot connection members 270A and 270B that are adapted to be connected in a pivotal or other hinged arrangement to the second side edge 230 of the socket plate 210 or alternatively to a portion of the adjacent wall 15. By such a hinged relationship the door member 210 is adapted to open and close in a door-like manner over a substantial or entire portion of the socket plate 10. This concept of deployment of the hinged cover door member 210 is that the door member closed over the socket plate 10 covers a portion of each electrical outlet plug 120A and 120B that is inserted into a particular socket 20A and 20B respectively, as shown in the drawings. The purpose of the cover door member 210 is to cover the socket plate 10, as well as a portion of any plug as inserted in a socket. For accomplishing this desired purpose, the cover door 210 has structural attributes as described above in order to enable the cover door 210 to be enclosed over any inserted plug. As stated, when the cover door 210 is closed, openings 250A and 250B are positioned on the cover door 210 to be aligned axially with the mating electrical sockets 20A and 20B on socket plate 10, and are of such a size so as to accommodate a portion of an electrical plug as seen in the drawings.

Thus, as can be seen in FIGS. 1, 2, 3 and 4 of the drawings the cover door member 210 has one or more openings 250A, 250B to accommodate in an axial manner a portion of an electrical plug 120A and 120B respectively when plugged in a socket as shown specifically in FIGS. 2 and 3 of the drawings. As stated, the openings 240A and 240B in the cover door are preferably rounded openings, but can be other than circular or rounded members so long as these openings are adapted to encase partially a portion of the outer perimeter of the plug in a surround manner. Specifically in the particular embodiment shown in the drawings, there are two openings 240A and 240B in the cover door member 210. As stated, these openings 240A and 240B can be other than rounded or circular so long as they are adapted to receive through such opening a portion of an electrical plug, particularly when plugged into a socket, and thus surround the outer circumferential surface of the plug, as shown in the drawings. Moreover, the number of such openings may vary from one up to any given number.

Thus, each of the openings 240A and 240B function to hold a portion of an electrical plug, as shown schematically in FIGS. 2 and 3. As can be seen from the drawings, in the preferred embodiment, the cover door member 210 is preferably not a flat member, but is formed with a bulge in the middle so as to provide some space to accommodate a part of each plug between the inner surface 280 of the cover door member 210 and the outer surface of socket plate 10, as shown. It is to be stressed, however, that the plate member may be flat so that the outer surface 300 of cover door member 210 is substantially parallel to the outer surface 30 of the socket plate 10. However, as can be seen from the drawings in the preferred embodiment of the subject invention, the cover door member 210 inner surface 290 is preferably concave so as to provide some spatial distance between such socket plate outer surface 30 and such inner surface of the cover door member 210. Alternate arrangements can be based on a flat cover member, in which the cover door member 210 has tunnel members surrounding the openings so as to circumferentially cover part of the electrical plug.

Attention is directed to FIG. 2, which is a frontal view of cover door member 210 and as shown in the drawings and as described above cover member 20 has openings in such member that are centered approximately but not necessarily in the middle of the cover door member 210 between side edges 220 and 230 and between the top and bottom edges 240 and 250. The longitudinally extending slits 250A and 250B that extends from each opening 240A and 240B to the side edge 220 that is not hinged of the cover plate 210 forms a break in the continuity of the cover door member 210 so that the plate is discontinuous along such side edge 220 as shown. These slits 250A and 250B are of such a width to enable the electrical cords to be threaded through as shown in the drawings so that cover door member 210 can be opened and closed without interference from the cord, i.e. to enable the cover door to be closed over the inserted plugs. Otherwise, the cover door member 210 could not be closed over inserted plugs when the electrical plugs are inserted.

In an alternate embodiment of the subject invention as seen in FIG. 2, cover door member 210 can be integrally attached, in a hinged manner, to plate 10 so that the socket plate 10 and the cover door member 210 are joined together as a unit member 400. More specifically, a reference to the drawing shown in FIG. 2, the inner socket plate 10 is structured essentially the same as a standard outlet cover plate, being basically a flat plate member that is shown as having a rectangular outer face. Again, the shape of such plate, as in the other embodiment, need not necessarily be rectangular. The two openings 240A and 240B are shaped and sized to surround the electrical plug members 130A and 130B.

In this latter embodiment, the socket plate 10 and the cover door member 210 constitute an integrated arrangement and in such integrated arrangement, the socket plate 10 and the cover plate 210 comprise one member with the cover door being semi-permanently or permanently hinged to the socket plate 10. In this arrangement, the socket plate 10 and the cove door 210 are structured just as described above, with all the particular attributes present for each individual member as previously discussed, there thus being no need to describe each separately as different units. In this latter arrangement, the overall unit is installed by attaching the socket plate 10 to the wall 15, with the attendant attached cover door 210 already attached.

By the foregoing arrangement, the electrical plug members 120A and 120B will be partially covered by the cover door 210 when it closes over the socket plate 10. By this arrangement, when the electrical plugs 130A and 130B are inserted into the electric outlet openings, the hinged cover member 210 can be enclosed over the plugs by drawing the plug cords 130A and 130B through the longitudinal slits 250A and 250B extending from the openings 240A and 240B from the side edge 220 of cover door member 210 so that the plugs need not be pulled out in closing or opening the hinged door. By this arrangement, the closed door will help prevent children from removing plugs when inserted and risking electrocution. For additional safety purposes, a lock 500 may be provided to a portion of the cover door member 210 to lock the door to a mating lock member in socket plate 10. In addition, the door will provide an aesthetic improvement to partially block the sight of inserted electrical plugs and will provide an improved energy conservation method to help keep cold air seeping into the room from the inner part of wall 15.

In summary, the subject invention is a safety cover for an electrical outlet comprising a pivotal door member. Such pivotal door member being pivotally mounted to a portion of the outer edge of an electrical outlet cover, with such pivotal door having openings therein that are adapted to receive a portion of an electrical plug with slits extending therein.

A further summary of the subject invention comprises a cover door for an electrical outlet plate adapted to be affixed to a wall, with such outlet plate having at least a first edge and a second edge. Such cover door comprising a hinged plate member with at least a first edge and second edge, said first edge being pivotally mounted to an edge of such outlet plate, and wherein such cover door has plug openings extending there through that are adapted to receive and surround a portion of an electrical plug, with such cover having a slit extending from openings to the first side edge of the cover door.

Yet another summary of the subject invention comprises an external covering door device for an electrical outlet cover plate attached to a wall of a building comprising and an electrical socket plate and having a first side edge and a second side edge, such socket plate door being affixed to the wall and having one or more openings therein, each such opening structured to surround and expose an electrical outlet and further comprising an external cover door member adapted to open and close from an open position over said outlet cover plate. Such external cover door member being affixed in a pivotal manner to the first side edge of said socket plate, such external cover door having one or more openings therein to be aligned with the respective openings in the electrical outlet plate with slits extending from the openings in the cover door member to at least one side edge of the cover door.

What is claimed is:

1. A combination of electrical outlet socket plate and a cover door comprising:

the electrical outlet socket plate being substantially rectangular and adapted to be affixed to a wall of a building, said socket plate having at least a first side edge, a second side edge, and a plurality of openings therein to surround electrical outlet sockets in the wall of the building;

the cover door being substantially rectangular and having a first side edge, a second side edge, and a plurality of plug openings therein, each of said openings adapted to receive and a surround a portion of an electrical plug, said cover door further includes a plurality of slits extending from said plug openings to the first side edge of the cover door, wherein the cover door at the second edge thereof is pivotally mounted to said outlet socket plate at its the second edge, such that, when the cover door is closed, the plugs inserted in the outlet sockets are safely prevented from removal and cords of the plugs pass through the slits.

* * * * *